United States Patent [19]

Peter

[11] 4,293,006

[45] Oct. 6, 1981

[54] PILE WARP THREAD UNWINDING DEVICE FOR A TERRY CLOTH LOOM

[75] Inventor: Erich Peter, Lindau, Fed. Rep. of Germany

[73] Assignee: Lindauer Dornier Gesellschaft mbH., Fed. Rep. of Germany

[21] Appl. No.: 17,336

[22] Filed: Mar. 5, 1979

[51] Int. Cl.[3] ..... D03D 49/10

[52] U.S. Cl. ..... 139/102; 139/25; 139/110

[58] Field of Search ..... 139/25, 26, 102, 109, 139/110, 24

[56] References Cited

U.S. PATENT DOCUMENTS

| | | | |
|---|---|---|---|
| 1,539,178 | 5/1925 | Giardino | 139/102 |
| 2,450,470 | 10/1948 | Dion | 139/110 |
| 2,489,231 | 11/1949 | Bourque | 139/24 |
| 2,625,021 | 1/1953 | Schoenster | 139/110 |
| 3,072,154 | 1/1963 | Locher | 139/110 |
| 3,105,524 | 10/1963 | Enloe | 139/110 |
| 3,463,198 | 8/1969 | Harkey | 139/25 |
| 3,900,051 | 8/1975 | Bucher | 139/25 |

FOREIGN PATENT DOCUMENTS

| | | | |
|---|---|---|---|
| 1952619 | 6/1970 | Fed. Rep. of Germany . | |
| 2221282 | 10/1973 | Fed. Rep. of Germany . | |
| 7503133 | 9/1976 | Netherlands | 139/25 |
| 1138641 | 1/1969 | United Kingdom | 139/25 |

*Primary Examiner*—Henry Jaudon
*Attorney, Agent, or Firm*—James E. Bryan

[57] ABSTRACT

This invention relates to an improvement in a pile warp thread-unwinding device for a terry cloth weaving machine with a drive for a pile warp beam controlled by an oscillatable reversing member for the pile warp threads, the improvement comprising two rotatable reversing means mounted in a stationary manner following the pile warp beam in the drawing-off direction of the threads, an oscillatable feeler means positioned therebetween whereby the warp threads are deflected from a straight path thereof, and means on said feeler means for influencing control switches for the pile warp beam drive.

7 Claims, 4 Drawing Figures

PILE WARP THREAD UNWINDING DEVICE FOR A TERRY CLOTH LOOM

Figure 2:
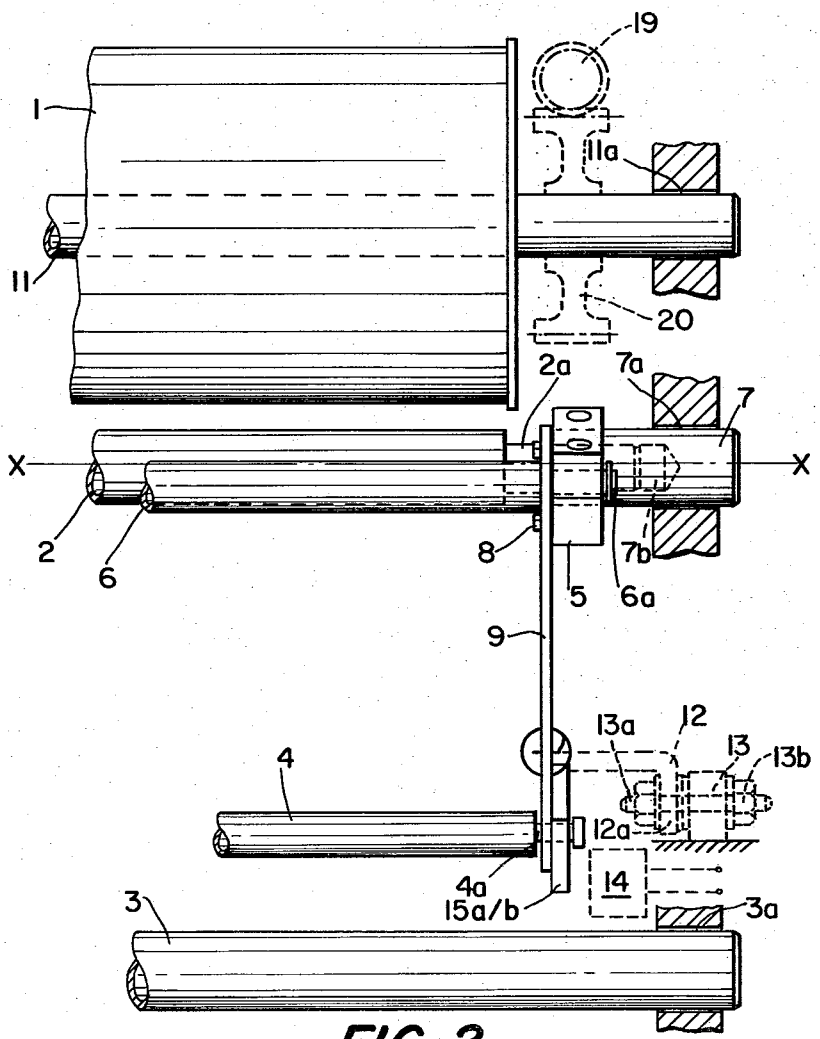

The present invention relates to a device for unwinding, or winding off, the pile warp threads in or for a loom for weaving terry cloth or Turkish towels.

In known devices of this kind, the pile warp thread is simply drawn off the pile warp beam and, thereby the pile warp beam is driven by the pile warp threads themselves. Required hereby is a braking device for the pile warp beam which is regulated in dependence upon the tension of the pile warp threads. Because the tension of the pile warp threads is intended to be constant during the entire weaving process, i.e. both with a full and with an almost empty pile warp beam, expensive regulating means for the brake are necessary and depend upon the respective diameter of the pile warp beam.

In other known devices, such as, for example, in the device described in German Offenlegungsschrift No. 1,952,619 June 18, 1970, the pile warp beam is motor driven until a specific supply of pile warp thread length has been unwound and is available for the thrust pile formation. The driving motor for the pile warp beam then remains turned off. Once this thread supply or reserve has been used up, the driving motor is turned on again until another supply or reserve has been effectively produced. Thereby the length of the thread supply or reserve is determined by the movement of a pendulum roll which, in its end positions, controls the driving motor by means of limit switches. The pendulum roll is hereby disposed behind a stationary reversing member for the pile warp threads, and the latter enwrap or loop around it at an angle of approximately 90° before they are further fed to the shed.

In yet another known device, for example that of German Offenlegungsschrift No. 2,221,282 published Oct. 31, 1973, the looping angle is almost 180°. The stroke of the pendulum movement is a direct indication for the supply or reserve length of the pile warp threads.

The known pendulum rolls are relatively heavy and are additionally also weighted in order to maintain the thread tension. Due to their large mass and their inertia, the pendulum rolls have a tendency—during the beating of the reed, i.e. when the pile warp thread supply is being fed—to produce too large an additional delivery of pile warp threads, which results in an uneven or irregular terry cloth web. If the pendulum roll oscillates at that time, the result is a strong fluctuation in the warp thread feed together with varying feeding lengths. This also has an adverse influence on the structure of the fabric, because every swinging variation of the pendulum roll is directly reflected in the feeding length of the pile warp threads. Furthermore, oscillations of the pendulum roll very adversely influence the switching behavior of the limit switches for the drive of the pile warp beam.

It is the object of the present invention to eliminate the disadvantages of the known devices outlined above and to provide a device which is significantly less sensitive to oscillations and which, moreover, allows for reducing the pile warp thread tension.

Starting out from the known pile warp thread-unwinding devices with a drive for the pile warp beam controlled by an oscillating reversing member for the pile warp threads, the inventive solution to the problem resides in two rotating reversing members disposed in a stationary manner following the nap warp beam in the drawing-off direction of the threads, an oscillatable feeler member arranged therebetween, which feeler member deflects the pile warp threads from the straight path thereof, and means for influencing the control switches for the pile warp beam drive.

According to a further embodiment of the present invention, the feeler member is equipped with means for non-contact actuation of the control switches for the pile warp beam drive and is additionally advantageously provided with an initial spring prestress.

The return force acting on the feeler member, whether by its own weight or additional spring force, need be only of such magnitude that the excess length of the pile warp threads forming the thread supply be deflected and maintained at slight tension.

In this construction of the feeler member and because of its small mass, also only small forces arise at the pile warp threads. As has been found in actual practice, the pile warp tension is extremely low and amounts at most to $\frac{1}{3}$ to $\frac{1}{4}$ of the present values. It is approximately 5 grams. For this reason also the tension of the base chain can be significantly reduced. Because of the low mass, the feeler member has a much lower tendency toward oscillations and therewith guarantees a uniform feed of the pile warp threads.

A still further essential advantage of the present invention resides in that, by virtue of the provision of the feeler member between two stationary reversing members, the pile warp threads are deflected from their stretched path between the reversing members, whereby the desired thread supply or thread reserve is available only in case of a relatively large deflection. This means that, as compared to the known devices, a significantly higher stroke exists in the present invention for the pendulum movement of the feeler member, which in actual practice amounts to a multiple of the stroke obtainable with known devices. As a result thereof, and because of the low tendency toward oscillations, a considerably better switching behavior of the control switches coordinated to the feeler member for the drive of the pile warp beam is effectively attained.

Figure 1:
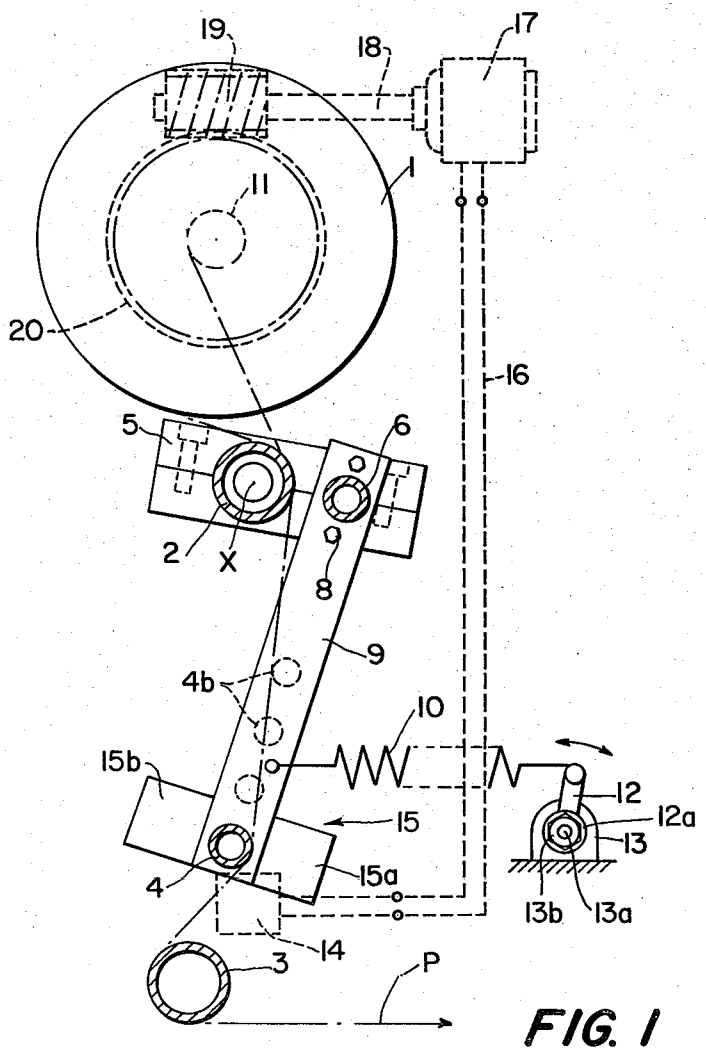
Figure 3B:
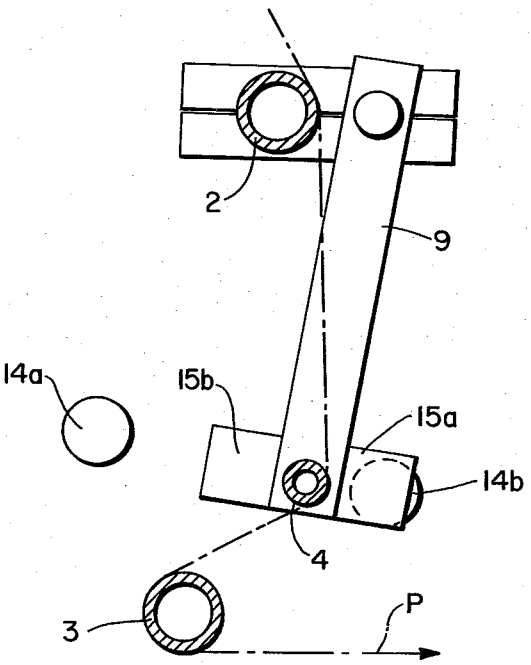
Figure 3A:
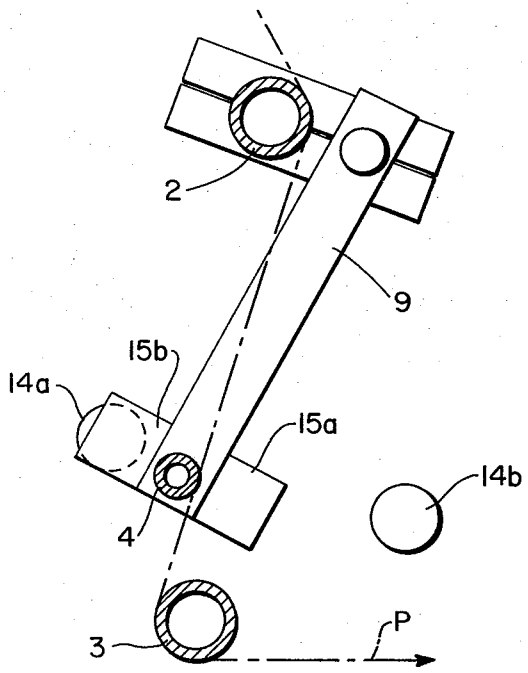

One embodiment of the present invention will now be further illustrated hereinafter on the basis of the accompanying drawings, wherein FIG. 1 is a schematic side view of the rearward part of a terry cloth weaving machine or loom, FIG. 2 is a view of FIG. 1, taken from the right, and FIGS. 3*a* and 3*b* show a portion of FIG. 2 in modified form, in two different end positions.

In the greatly simplified drawing, only one machine side is shown. The arrangement on the other machine side is essentially mirror-inverted with respect thereto. Reference numeral 1 designates the pile warp beam, and reference numeral 11 designates the pile warp beam axle. The axle 11 is rotatably mounted within a bearing 11*a* in a lateral wall of the weaving machine or loom which is indicated by shaded lines in the right-hand portion of FIG. 2 but is not otherwise identified. The drive of the pile warp beam is implemented, in known manner, intermittently by an electric motor and therefore is indicated in phantom. A crown gear 20 is mounted on the shaft 11 of the pile warp beam 1 and engages a worm gear 19. The worm gear 19 is driven by a shaft 18 from an electric motor 17. The motor 17 in turn is connected by an electric line 16 with a control switch 14 which will be discussed in further detail below. The control switch 14 turns "on" the drive 17 of the pile warp beam 1 when a supply of pile warp threads is required for the loop formation in the fabric, and turns the drive "off" again when an adequate supply has been formed. The switch 14 acts in the same manner as the limit switches activated by a pendulum roll, referred to on page 1. The design of the switch itself can be arbitrary, for instance limit switches mechanically actuated by the pendulum roll or also contactless switches may be provided. Also rotatably mounted in the lateral machine or loom wall are two stationary reversing members 2 and 3. These two reversing members 2 and 3 are positioned so as to be approximately vertically superimposed with respect to each other. The positioning of the, for example, tubular reversing member 3 in the lateral wall is designated with reference numeral 3*a* in FIG. 2. The also tubular reversing member 2 terminates in a pin 2*a* which is rotatably positioned in a longitudinal bore 7*b* of an axle or shaft piece 7. The axle piece 7 is, in turn, rotatably positioned at 7*a* in the lateral machine wall. The common axis of rotation for the reversing member 2 and the axle piece 7 is identified with reference symbol X. Secured to the axle piece 7 is a supporting block 5; for example: two partial blocks are held together by means of screws and are clamped onto the axle piece 7. Secured to the supporting block 5 is an oscillatable lever 9, for instance by means of the screws 8. Rotatably positioned at the lower end of the oscillatable lever 9 is a feeler member 4, which is in this case a thin tube. The positioning is indicated by reference numeral 4*a* in FIG. 2. The feeler member is thus located between the two stationary reversing members 2 and 3. Because both of the stationary reversing members 2 and 3 and also the feeler member 4 are respectively rotatably positioned, practically no friction must be overcome by the pile warp threads.

By virtue of the mirror-image provision on the other machine side, and by means of an upper connecting rod 6 between the two supporting blocks 5 on the two machine sides, a light yet stable and torsion-resistant frame is effectively formed, one side of which consists of the feeler member 4. Reference numeral 6*a* identifies the pin of the connecting rod 6 being retained within the supporting block 5. The entire frame formed by the two oscillatable levers 9, the feeler member 4, and the connecting rod 6 is adapted to swing about the axis of rotation X of the reversing member 2. This arrangement effectively prevents an oblique position of the feeler member 4 during operation and hence guarantees a uniform thread delivery over the entire weaving width.

Suspended at the oscillatable lever 9 is a spring 10 which is connected on the other hand at a fixed point 13 on the machine. Produced in this manner for the feeler member 4 is an initial spring stress which acts laterally against the taut pile warp threads. The course of the nap warp threads P has been indicated in dash-dotted lines. The pile warp threads P originate from the pile warp beam 1, are guided in FIG. 1 at the right about the stationary reversing member 2, are deflected by the feeler member 4 more or less strongly from their stretched path or course, and will then loop around the second stationary reversing member 3 before they are further fed to the shed in the direction of the arrow. The force of the spring 10 is such that it will deflect the thread length of supply and keep it at a slight tension. The relationship of the distances of the oscillatable feeler member 4 from the stationary reversing members 2 and 3 determines the length of the pile warp thread supply or reserve which is respectively intended to be produced. It is therefore advantageous that the length of the oscillatable lever 9 be adjustably provided in any known manner which has, however, not been illustrated herein. For example, several positioning or bearing possibilities may be selectively provided for the feeler member 4 along the oscillatable lever 9.

The adjustability obtained from several fastening apertures 4*b* is indicated in FIG. 1. The feeler member 4, depending upon the particular requirements, can be selectively fastened or rotatably supported in these apertures.

It is further advantageous to also provide the spring tension of the initial stress for the feeler member 4 in an adjustable manner. It is therefore indicated in the drawing that the spring 10 does not engage directly at the fixed point 13 on the machine but instead at a pivotal adjusting arm 12. This adjustability is shown in FIG. 1 by a double arrow at the adjusting arm 12. To obtain adjustability for the spring 10, the arm 12 may be provided with a flange 12*a* at its end, for instance, this flange resting against a lug of the fixed point 13. A bolt 13*a* passes through both parts; a screw nut 13*b* is threaded onto this bolt. After the threaded connection is loosened, the arm 12 can be pivoted about the bolt 13*a*, as indicated by the arrow, and hence the prestress of the spring 10 can be adjusted. Following the adjustment, the new position of the arm 12 is locked by tightening the nut 13*b*. If desired, the flange 12*a* and the lug of the fixed point 13 may be provided with a mutually meshing gearing or engaging knurling to facilitate the positioning of the arm 12".

To control the electric motor drive for the pile warp beam 1, contactless switches are provided here in the illustrative embodiment. To that end the oscillatable lever 9 also carries at its end means for the non-contact actuation of the control switches for the drive of the pile warp beam. Provided for this purpose at the oscillatable lever 9, is, for instance, a control plate 15 for a magnetic or inductive control switch 14 which is shown in dash-dotted lines in FIG. 2.

As already mentioned above, the control switch 14 operates in the manner of limit switches at the end points of a motion. The control plate 15 mounted to the oscillatable lever 9 in this instance is divided into two partial plates 15*a* and 15*b* for instance, which are oppositely magnetized and correspondingly act in a different manner on the control switch 14.

In the present case, switching procedures are triggered at the end of the reversing locations of the oscillating motion of the oscillatable lever 9. FIG. 1 also shows an intermediate position of the oscillatable lever 9. In one end position of the oscillatable lever 9, far beyond what is shown in FIG. 1, the pile warp threads P would extend stretched and straight between the reversing rollers 2 and 3, that is, no thread supply would be available for the loop formation in the fabric. In the indicated end position, the partial control plate 15*a* would be moved directly in front of the control switch 14 and actuate it, whereby the drive 17 for the pile warp beam 1 would be turned on through the electric line 16. The moment this takes place, the pile warp beam provides a thread supply. The feeler member 4 with the oscillatable lever 9 keeps the delivered supply of thread slightly stretched by means of the spring 10, and the supply therefore is deflected to the right in FIG. 1. The larger the supply of thread formed, the farther to the right the deflection. The moment the required supply of thread has been formed, the feeler member 4 together with the oscillatable lever 9 will be in its right-hand end position, which would be to the right of the intermediate position shown in FIG. 1. In that end position, the partial control plate 15*b* is located directly in front of the control switch 14, and, because of its opposite magnetization, turns it off. Accordingly the drive 17 for the pile warp beam 1 is turned off again through the line 16. The drive remains turned off until the supply of thread that was formed is exhausted in the weaving process and the switch 14 is again acted on by the partial plate 15*a*. In this manner a uniform supply of thread is always automatically formed and used up again.

FIGS. 3*a* and 3*b* show a further possible way of arranging the switches for the pile warp beam drive. A portion of FIG. 2 is shown schematiclly with the spatially fixed reversing rollers 2 and 3, and with the oscillatable frame formed by the feeler member 4, oscillatable levers 9 and connecting rod 6. Here also a contactless switch is assumed, and to that end again a control plate 15 is mounted at the end of the oscillatable lever 9. The difference with respect to FIG. 2 is that a separate switch is mounted as a limit switch at each of the sites of direction reversal of the oscillatable member. A single structure, that is without different magnetization, is provided in this case as the control plate 15.

In the left-hand end position of the oscillatable lever 9 shown in FIG. 3*a*, for which no thread supply is present and the pile warp threads P run straight between the spatially fixed reversing rollers 2 and 3, the control plate 15 acts on the switch 14*a* which, in a manner not further described, turns "on" the pile warp thread drive. The driven pile warp beam supplies a supply of thread which in its end position follows the path indicated in FIG. 3*b* due to the action of the feeler member 4. In this case, the control plate 15 acts on the limit switch 14*b* and the pile warp beam drive is turned "off" again. If now the supply of thread decreases during the weaving process, the oscillatable lever 9 together with the feeler member 4 slowly moves again leftward in relation to the decrease in supply and, when in its end position, again causes the pile warp beam drive to be turned "on" and hence causes the formation of a new supply of thread.

It will be obvious to those skilled in the art that many modifications may be made within the scope of the present invention without departing from the spirit thereof, and the invention includes all such modifications.

What is claimed is:

1. In a pile warp thread-unwinding device for a terry cloth weaving machine with an intermittent drive for a pile warp beam controlled by an oscillatable feeler for the pile warp threads, the improvement comprising two rotatable reversing means mounted in a stationary manner following the pile warp beam in the drawingoff direction of the threads, said oscillatable feeler being positioned therebetween and movable between two limit positions, said feeler in one limit position thereof being located essentially in a plane formed by the pile warp thread extending in a straight path between said two reversing means, means urging said feeler in a direction out of said one limit position toward said other limit position so as to deflect said pile warp threads from said straight path, and means on said feeler for influencing electrical control switches for the pile warp beam drive in the limit positions of the feeler.

2. A device according to claim 1 in which said means urging said feeler in the direction out of said one limit position is a spring.

3. A device according to claim 1 in which the feeler is part of a pivotally mounted frame.

4. A device according to claim 3 in which the feeler includes a tube rotatably positioned within said frame.

5. A device according to claim 3 in which the frame is pivotally positioned coaxially with a first stationary reversing member.

6. A device according to claim 3 including means on said frame for non-contact actuation of said control switches.

7. A device according to claim 1 including means whereby the distance of said feeler from an axis of rotation thereof is adjustable.

* * * * *

UNITED STATES PATENT AND TRADEMARK OFFICE

CERTIFICATE OF CORRECTION

PATENT NO. : 4,293,006

DATED : October 6, 1981

INVENTOR(S) : Erich Peter

It is certified that error appears in the above—identified patent and that said Letters Patent is hereby corrected as shown below:

Item 30 has been omitted and should read as follows:

--- Foreign Application Priority Data

April 20, 1978 (DE) Fed. Rep. of Germany . . . . . .2817185 ---;

In the Abstract, line 4 from the bottom, the word "pile" has been omitted before "warp".

Column 1, line 5, the word --- designed --- has been omitted after "device".

Column 3, line 54, "nap" should read --- pile ---.

Signed and Sealed this

*Sixteenth* Day of *February 1982*

[SEAL]

*Attest:*

GERALD J. MOSSINGHOFF

*Attesting Officer*

*Commissioner of Patents and Trademarks*